US005875653A

United States Patent [19]

Pedersen

[11] Patent Number: 5,875,653

[45] **Date of Patent: *Mar. 2, 1999**

[54] KNITTED SWEATER OF CORRESPONDING GARMENT ARTICLE, AND A METHOD OF MANUFACTURING IT

[75] Inventor: Peter Pedersen, Silkeborg, Denmark

[73] Assignee: Grethe Thomassen, Silkborg, Denmark

[ * ] Notice: This patent issued on a continued prosecution application filed under 37 CFR 1.53(d), and is subject to the twenty year patent term provisions of 35 U.S.C. 154(a)(2).

[21] Appl. No.: 428,184

[22] PCT Filed: Aug. 5, 1994

[86] PCT No.: PCT/DK94/00300

§ 371 Date: May 2, 1995

§ 102(e) Date: May 2, 1995

[87] PCT Pub. No.: WO95/04850

PCT Pub. Date: Feb. 16, 1995

[30] Foreign Application Priority Data

Aug. 5, 1993 [DK] Denmark ..... 0907/93

[51] Int. Cl.[6] ..... A41B 1/00; A41D 1/04

[52] U.S. Cl. ..... 66/171; 2/90; 2/116; 28/100

[58] Field of Search ..... 2/90, 116, 113–115, 2/122, 139; 66/171, 177, 195; 28/100

[56] References Cited

U.S. PATENT DOCUMENTS

| | | | |
|---|---|---|---|
| 2,222,090 | 11/1940 | Schaumer | 2/113 |
| 2,456,190 | 12/1948 | Heilbronner | 2/113 X |
| 3,299,486 | 1/1967 | Meyers et al. | 66/177 X |
| 4,087,991 | 5/1978 | Robinson et al. | 2/90 X |
| 4,392,258 | 7/1983 | O'Neill | 2/115 X |
| 4,613,336 | 9/1986 | Quinnen | 8/494 |
| 4,863,775 | 9/1989 | Jacobs et al. | 428/91 |
| 5,515,699 | 5/1996 | Weingarten et al. | 28/100 X |
| 5,519,925 | 5/1996 | Ball et al. | 28/100 X |

*Primary Examiner*—John J. Calvert
*Attorney, Agent, or Firm*—Antonelli, Terry, Stout & Kraus, LLP

[57] ABSTRACT

The invention is a garment and a process for making a garment. A garment in accordance with the invention includes a plurality of sewn together prewashed and shrunk knitted pieces each made from cotton yarn and each having a low residual shrinkage after preworking and shrinking; and at least one woven piece of fabric stitched to the plurality of sewn together knit pieces.

24 Claims, 1 Drawing Sheet

KNITTED SWEATER OF CORRESPONDING GARMENT ARTICLE, AND A METHOD OF MANUFACTURING IT

BACKGROUND OF THE INVENTION

FIELD OF THE INVENTION

The present invention relates to a knitted sweater or a corresponding garment article, and to a method of manufacturing such a knitwear article.

SUMMARY OF THE INVENTION

A special feature of this article is that it is knitted of a special yarn, viz. preferably indigo dyed cotton yarn, that is the same type of yarn as used in the so-called cowboy or denim cloth, known for being extraordinarily wear resistant, though not particularly soft. The yarn is rather difficult to use in knitting machines, but it may be used, after all, and the product is a knitwear which is softer that the woven fabric and thus well suited for knitted sweaters and the like, which will then similarly be highly wear resistant.

Certain parts of the garment, viz. the collar and the so-called button-bands, i.e. the vertical front side parts in which there is mounted cooperating snap fasteners or provided buttons and button holes, respectively, may advantageously, both stylewise and functionally, be made of the said woven and more rigid denim/jeans fabric. The invention relates to this particular combination, i.e. to a knitwear article having a collar of a rigid character and optionally having button-bands well suited as a mounting base for closure means, all with a harmonic fabric selection with consistent use of extra wear resistant and almost unlimited washable materials.

However, there is a problem in that the knitted fabric will shrink in washing more that the woven fabric, whereby there is a pronounced risk of a forthcoming formation of folds along the woven fabric pieces. It is known that this type of improvement can be made in arranging for the more rigid parts to be stretched by the stitching together with the other parts, just as during the stitching work it is possible to compress the less rigid fabric, but such a technique is unsuitable when, as here, relatively marked differences are in question.

With the invention it is a basic condition that an already indigo dyed cotton yarn is made into fully-fashioned knitwear pieces in flat knitting machinery, and that these pieces are subsequently sewn together for forming the desired knitwear articles. According to the present invention the fully-fashioned knitwear pieces as produced by the flat knitting are made of a relatively loose knitting with a pronounced oversize amounting to some 20–40% and preferably 30–35%, whereafter these pieces are subjected to a washing treatment with a following accelerated drying, preferably by washing in bundles with a subsequent tumbler drying, whereafter the fabric pieces are sewn together, partly with each other and partly with one or more of the said woven fabric parts for the formation of the final product. By this method the knitwear pieces will shrink to suitable sizes and to a suitable rigidity of the knitting, and it is a resulting consequence that the woven fabric pieces can now be stitched on with a minimum of attention and without any special stretching requirements. The knitted fabric pieces will be practically ready-shrunk and 'condensed', such that later on the woven pieces will not get wrinkled. In departing from a pronounced loose knitting the fabric pieces may be so widely deformed that a possible rest shrinkage later on will correspond to a modest shrinking of the woven fabric, and the conditions may be so adapted that the two types of fabric will behave uniformly.

As products, knitwear articles according to the invention are characteristic in that as fresh from the factory products they appear with sewn together, fully-fashioned knitwear pieces assuming a state in which, as a result of a previous washing treatment, they are condensed so as to have a low residual shrinkability also in the areas where the said woven fabric pieces are sewn on, whereby the joining areas can be smooth.

DESCRIPTION OF THE PREFERRED EMBODIMENT

Figure 1:
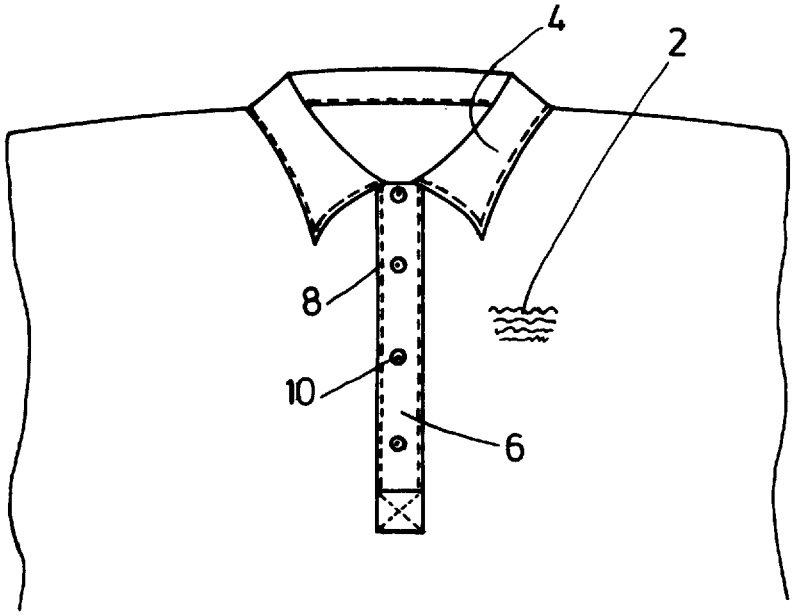
FIG. 1 illustrates a preferred embodiment of the invention.

In the following the invention is described in more detail with reference to the drawing, which shows a sweater according to the invention. The sweater shown is generally made of a knitted fabric 2 of indigo dyed cotton yarn, with a stitched-on collar 4 and button-bands 6 and 8 as woven fabric pieces of a corresponding yarn, whereby the collar constitutes a smooth and rigid part while the button bands form solid base parts for the fixation of buttons or snap fasteners, optionally for the provision of button holes.

The single knitwear pieces stitched together for forming the sweater are knitted on flat knitting machinery as fully-fashioned pieces with a relatively loose knitting and with an oversize of 30–35%. Thereafter the pieces are brought to a laundry, where they are washed, not necessarily with soap, and dried in a drying tumbler, whereby they are shrunk to the desired size and density. Thereafter the preshrunk pieces are sewn together, mutually and with the woven pieces 4 and 6,8, whereafter the product is handled as a unit. The woven pieces can be fixed by ordinary smooth sewing, without special complications or precautions.

The new sweater may shrink slightly when being washed, but not with any disproportion between the shrinking of the knitted fabric and the woven parts, such that the sweater will generally maintain its shape.

It will be understood that the invention is not limited to the bands 6,8, if any, being short or long, i.e. whether or not they are through-going along the front side of the sweater. Moreover the article may be provided with additional pieces of the woven fabric in selected areas, e.g. in a facing area at the front side, though this will be a matter of design only. The invention makes it possible to work almost uncritically with the discussed fabric combination, this applying generally to cotton products and widely comparable products.

I claim:

1. A garment comprising:

a plurality of sewn together fully-fashioned knitwear fabric pieces each made from knitted cotton yarn and each, prior to being sewn together, being relatively loosely knitted with a pronounced oversize, and being laundered prior to being sewn together to shrink the oversized pieces to a suitable size and density and a state of low residual shrinkage; and at least one woven piece of fabric which is more rigid than said shrunk fully-fashioned knitwear fabric pieces stitched to the plurality of sewn together knitwear fabric pieces at smooth joining areas whereby with a subsequent washing of the garment said at least one piece of woven fabric of said garment will not get wrinkled.

2. A garment in accordance with claim 1 wherein:

the at least one woven piece of fabric is made from cotton yarn.

3. A garment in accordance with claim 1 wherein:

the cotton yarn of the plurality of sewn together knitwear fabric pieces is indigo dyed.

4. A garment in accordance with claim 2 wherein:

the at least one woven piece of fabric is made from indigo dyed cotton yarn.

5. A garment in accordance with claim 1 wherein:

the cotton yarn of the plurality of sewn together knitwear fabric pieces is indigo dyed; and the at least one woven piece of fabric is made from indigo dyed cotton yarn.

6. A garment in accordance with claim 1 wherein:

the at least one woven piece comprises a collar and button bands.

7. A garment in accordance with claim 2 wherein:

the at least one woven piece comprises a collar and button bands.

8. A garment in accordance with claim 3 wherein:

the at least one woven piece comprises a collar and button bands.

9. A garment in accordance with claim 4 wherein:

the at least one woven piece comprises a collar and button bands.

10. A garment in accordance with claim 5 wherein:

the at least one woven piece comprises a collar and button bands.

11. A garment in accordance with claim 1 wherein:

the at least one woven piece of fabric covers part of at least one knit piece.

12. A garment in accordance with claim 1 wherein:

the knitwear fabric pieces are shrunk in an amount in the range of 20% to 40%.

13. A process for manufacturing a garment comprising:

knitting a plurality of fully-fashioned knitwear fabric pieces each made from cotton yarn and being relatively loosely knitted with a pronounced oversize;

washing and drying the plurality of knitwear fabric pieces to shrink the plurality of oversized pieces to a suitable size and density and a state of low residual shrinkage;

providing at least one piece of woven fabric which is more rigid than said shrunk, fully-fashioned knitwear fabric pieces; and sewing the plurality of shrunk knitwear fabric pieces together and stitching the at least one piece of woven and more rigid fabric to the sewn together plurality of shrunk knitwear fabric pieces at smooth joining areas to assemble the garment whereby with subsequent washing of said garment said at least one piece of woven fabric of said garment will not get wrinkled.

14. A process in accordance with claim 13 wherein:

the at least one woven piece of fabric is made from cotton yarn.

15. A process in accordance with claim 13 wherein:

the cotton yarn of the plurality of sewn together knitwear fabric pieces is indigo dyed.

16. A process in accordance with claim 14 wherein:

the at least one woven piece of fabric is made from indigo dyed cotton yarn.

17. A process in accordance with claim 13 wherein:

the cotton yarn of the plurality of sewn together knitwear fabric pieces is indigo dyed; and the at least one woven piece of fabric is made from indigo dyed cotton yarn.

18. A process in accordance with claim 13 wherein:

the at least one woven piece comprises a collar and button bands.

19. A process in accordance with claim 14 wherein:

the at least one woven piece comprises a collar and button bands.

20. A process in accordance with claim 15 wherein:

the at least one woven piece comprises a collar and button bands.

21. A process in accordance with claim 16 wherein:

the at least one woven piece comprises a collar and button bands.

22. A process in accordance with claim 17 wherein:

the at least one woven piece comprises a collar and button bands.

23. A process in accordance with claim 13 wherein:

the at least one woven piece of fabric covers part of at least one knitwear fabric piece.

24. A process in accordance with claim 13 wherein:

the knitwear fabric pieces are shrunk in the range of 20% to 40% in said washing and drying step prior to said sewing together.

* * * * *